US008258419B2

(12) United States Patent
Jeong et al.

(10) Patent No.: US 8,258,419 B2
(45) Date of Patent: Sep. 4, 2012

(54) HIGH-SPEED CLOSING SWITCH IN POWER DISTRIBUTOR

(75) Inventors: Young Woo Jeong, Chungcheongbuk-Do (KR); Hyun Wook Lee, Chungcheongbuk-Do (KR); Hae Eun Jeong, Chungcheongbuk-Do (KR); Yang Seop Sin, Gyeonggi-Do (KR); Young Keun Kim, Chungcheongbuk-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 318 days.

(21) Appl. No.: 12/624,896

(22) Filed: Nov. 24, 2009

(65) Prior Publication Data

US 2010/0133080 A1 Jun. 3, 2010

(30) Foreign Application Priority Data

Dec. 3, 2008 (KR) ..... 10-2008-0122121

(51) Int. Cl.
*H01H 33/70* (2006.01)

(52) U.S. Cl. ..... 218/68

(58) Field of Classification Search ..... 218/57–68
See application file for complete search history.

(56) References Cited

U.S. PATENT DOCUMENTS

| | | | | |
|---|---|---|---|---|
| 2,951,188 | A | 8/1960 | Diebold | |
| 4,435,627 | A | 3/1984 | Barth et al. | |
| 4,475,017 | A * | 10/1984 | Karrenbauer | 218/57 |
| 5,296,662 | A * | 3/1994 | Engdahl et al. | 218/93 |
| 5,892,194 | A * | 4/1999 | Uotome et al. | 218/68 |
| 5,898,150 | A * | 4/1999 | Gallix et al. | 218/66 |
| 6,921,989 | B2 * | 7/2005 | Baranowski et al. | 307/139 |
| 7,078,643 | B2 * | 7/2006 | Rostron et al. | 218/144 |
| 2009/0166168 | A1 | 7/2009 | Nakauchi et al. | |

FOREIGN PATENT DOCUMENTS

| | | |
|---|---|---|
| EP | 2073229 | 6/2009 |
| FR | 2357048 | 1/1978 |
| FR | 2493031 | 4/1982 |
| GB | 1449015 | 9/1976 |
| JP | 55-87640 | 6/1980 |
| JP | 60-130522 | 9/1985 |
| JP | 01-258331 | 10/1989 |
| JP | 8-064084 | 3/1996 |
| JP | 2000-331576 | 11/2000 |
| JP | 2002-56752 | 2/2002 |
| JP | 2006-81385 | 3/2006 |
| WO | 96/19816 | 6/1996 |

OTHER PUBLICATIONS

Japan Office action, mail date is Oct. 18, 2011.

* cited by examiner

*Primary Examiner* — Truc Nguyen
(74) *Attorney, Agent, or Firm* — Greenblum & Bernstein P.L.C.

(57) ABSTRACT

A high speed closing switch in a power distributor includes: a case forming an external appearance; a first electrode provided within the case and including a through hole; a second electrode having a receiving recess facing the through hole; a moving contact point member having a cylindrical portion received in the through hole so as to be put into the receiving recess and a flange portion formed at one end of the cylindrical portion; and a closing coil wound on a base of the case, wherein a damping hole is formed at receiving recess of the second electrode. When the moving contact point member put into the receiving recess approaches its final position, a damping force is applied to the moving contact point member to stably and accurately control the final position.

14 Claims, 5 Drawing Sheets

HIGH-SPEED CLOSING SWITCH IN POWER DISTRIBUTOR

BACKGROUND OF THE INVENTION

1. Field of the Invention

The present invention relate to a breaker switch introduced at a high speed within a power distributor and, more particularly, to a high-speed closing switch capable of minimizing damage possibly resulting from an arc accident of a power distributor by inputting high voltage power to a ground at a high speed to detour an accident current immediately when the arc accident occurs at the power distributor.

2. Description of the Related Art

In general, a power distributor is a facility that converts power of an is especially high voltage into a low voltage and distributing the same to provide power required by a load facility installed at each consumer, and in general, the power distributor includes a switch, a lightning arrester, a transformer, a breaker and various other measurement equipments.

The breaker provided in the power distributor refers to a device that breaks current when a line is switched on or off or when an accident such as short circuit occurs, and stably protects a power system by switching on or off a line as necessary even in a normal state as well as in an abnormal state such as short circuit. The breaker includes a breaking unit insulated with an insulating material within a tank-type container filled with $SF_6$, an inert insulating gas having good insulation characteristics and being tasteless, odorless, and nonpoisonous.

When an arc is generated within a power distributor circuit, an internal device such as various measurement equipments or the like may be damaged due to high temperature and high pressure of the arc, and according to circumstances, insulation is broken to do damage to the user who comes in contact therewith. Thus, the arc-resistance measure is required to cope with such situation. When an arc is generated in the power distributor, a trip speed of the breaker is not sufficiently faster than the arc speed to cut off the accident current, so the breaker is not effective.

Most arc-resistance structure used in the power distributor is that a passage for discharging internal pressure is installed to lower pressure increased due to arc or a mechanical strength of a structure is increased to structurally tolerate an increased temperature and pressure according to an arc accident. Or, a dedicated arc breaking device is used to cope with an arc generation.

However, when an arc is generated, it reaches its maximum temperature and pressure very quickly, so the related art method cannot effectively cope with the arc speed. Also, in case of using a high speed arc breaking (interrupting) device, a moving unit of the breaking device should move at a high speed to cope with the arc speed. In this respect, a movement speed of the moving unit should be reduced at a final position of the moving unit to reduce an impact and properly control the position. However, because the moving unit of the breaking device moves at a high speed, it is difficult to reduce the final speed, and thus, it is difficult to control the final position of the moving unit.

SUMMARY OF THE INVENTION

Therefore, in order to address the above matters, the various features described herein have been conceived. One aspect of the exemplary embodiments is to provide a high speed closing switch capable of quickly extinguishing an arc generated in a power distributor.

Another aspect of the present invention is to provide a means for effectively controlling a final position of a moving unit of a switch when the moving unit moves at a high speed.

This specification provides a high speed closing switch in a power distributor, including: a case forming an external appearance; a first electrode provided within the case and including a through hole; a second electrode having a receiving recess facing the through hole; a moving contact point member having a cylindrical portion received in the through hole so as to be input into (put into, injected into, or inserted into) the receiving recess and a flange portion formed at one end of the cylindrical portion; and a closing coil wound on a base of the case, wherein a damping hole is formed at receiving recess of the second electrode.

With the configuration of the damping hole formed at the receiving recess, when the moving contact point member approaches the final position, a damping force is applied to the moving contact point member, to thus stably and accurately control the final position.

In the inputting operation, the moving contact point member is input into the receiving recess upon receiving a repulsive force by the closing coil, and an opening coil is wound on one side of the first electrode and provides a repulsive force to the moving contact point member in an opening operation.

The cylindrical portion of the moving contact point member is formed to be hollow, and a guide member is provided at a base of the case and inserted in the hollow of the cylindrical portion to guide a movement of the cylindrical portion.

A contact element in contact with the moving contact member is formed on an inner circumferential surface of the through hole of the first electrode and on an inner circumferential surface of the second electrode. The contact elements may be a protrusion in a spiral recess formed on the inner circumferential surface of the through hole or a spring mounted in the spiral recess formed on the inner circumferential surface of the through hole.

The high speed closing switch further includes a pipe with one side of an inner circumferential surface to which the first electrode is combined and the other side combined with the base of the case.

The damping hole may be formed in a radius direction at an upper portion of the receiving recess of the second electrode. One or more damping holes may be formed. If a plurality of damping holes are formed, they may be formed radially in the radius direction at the upper portion of the receiving recess.

The first electrode is connected to a ground, and the second electrode is connected to a high voltage side.

The interior of the case is filled with an inert gas and hermetically closed, and the inert gas may be $SF_6$, $N_2$ or air without moisture.

In order to electrically connect the first and second electrodes, the first electrode is put into the receiving recess formed at the second electrode, and at this time, the gas within the receiving recess is discharged through the damping hole formed at the receiving recess.

The second electrode is put into the receiving recess by a repulsive force between the second electrode and a coil positioned at a lower side of the second electrode.

The foregoing and other objects, features, aspects and advantages of the present invention will become more apparent from the following detailed description of the present invention when taken in conjunction with the accompanying drawings.

DETAILED DESCRIPTION OF THE INVENTION

A high speed closing switch of a power distributor according to exemplary embodiments of the present invention will now be described with reference to the accompanying drawings.

Figure 1:
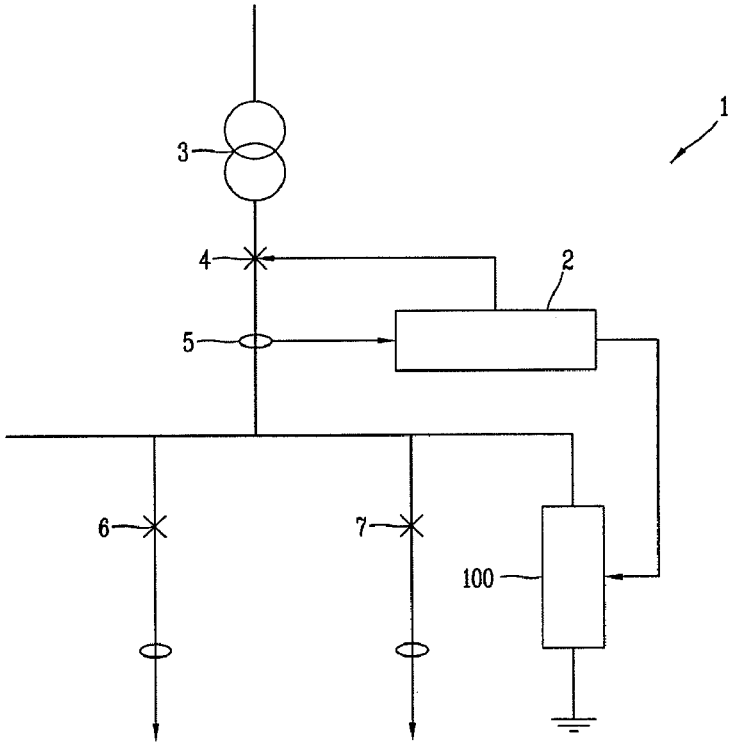
FIG. 1 is an overall outline view showing a power distributor according to an embodiment of the present invention.

FIG. 1 is an overall outline view showing a power distributor according to an embodiment of the present invention.

A power distributor 1 according to an embodiment of the present invention includes an arc-extinguishing system 2, a transformer 3, a main breaker 4, a current sensor 5, a first breaker 6, a second breaker 7, and a high speed closing switch 100.

In order to deal with an arc generated in the power distributor, when an arc generated within a control system (not shown) of the power distributor 1 is detected, a trip signal is transmitted to the main breaker 4 and, at the same time, the dedicated high speed closing switch 100 is operated. Then, the high speed closing switch 100 detours an arc accident current toward a ground to thereby minimize damage that may be generated due to the arc within the power distributor. Thereafter, the main breaker 4 shuts out the accident current to thus perfectly resolve an accident and protect the power distributor.

In order to determine the occurrence of an arc accident, a light receiving sensor for receiving light discharged from a generated arc is installed within the power distributor. Thus, when an arc accident occurs, a light signal detected by the light receiving sensor is transmitted to a system body or an overcurrent signal output from a current sensor provided in the power distributor is transmitted to the system body, and a control system can determine whether or an arc accident has occurred based on the conditions. Alternatively, whether an accident has occurred may be determined by simultaneously transmitting two signals.

When an arc accident occurs, a main body of the control system transmits a signal to the main breaker 4. At this time, because it takes a long time for the main breaker 4 to operate (namely, about 50 ms is taken), the main breaker 4 cannot quickly cope with the arc accident, so the dedicated high speed closing switch reacting at a faster speed is required. In other words, when an arc is generated, it reaches the highest temperature (20,000K) and pressure (2×105 Pa) within 10 ms to 15 ms. Thus, if an arc is generated, the dedicated high speed closing switch needs to complete the accident determination and closing operation within 5 ms until the arc is grounded.

Figure 2:
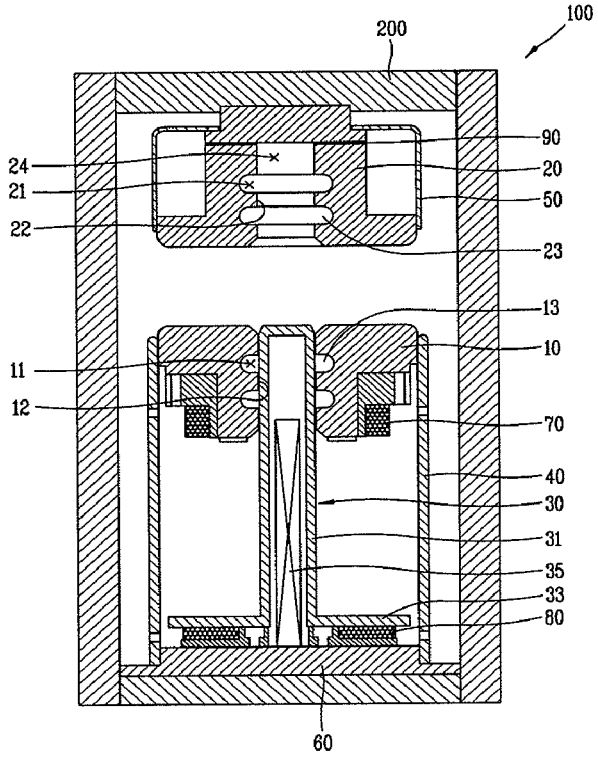
FIG. 2 is a sectional view of a high speed closing switch of FIG. 1.
Figure 3:
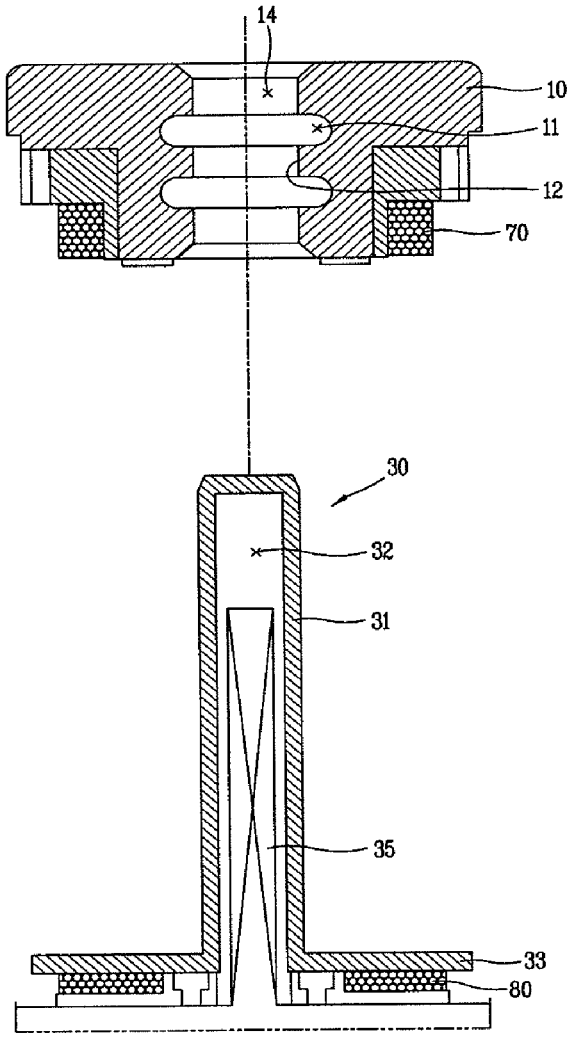
FIG. 3 is a detailed sectional view of a first electrode and a moving contact point member of FIG. 2.
Figure 4A:
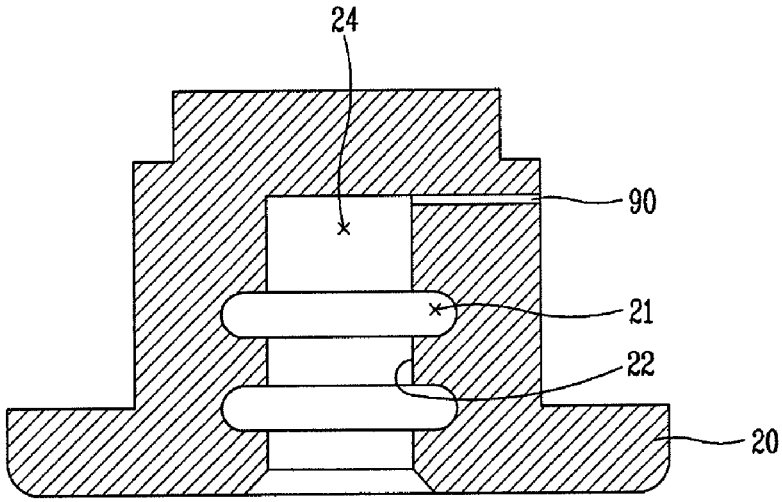
FIG. 4A is a detailed sectional view of a second electrode.
Figure 4B:
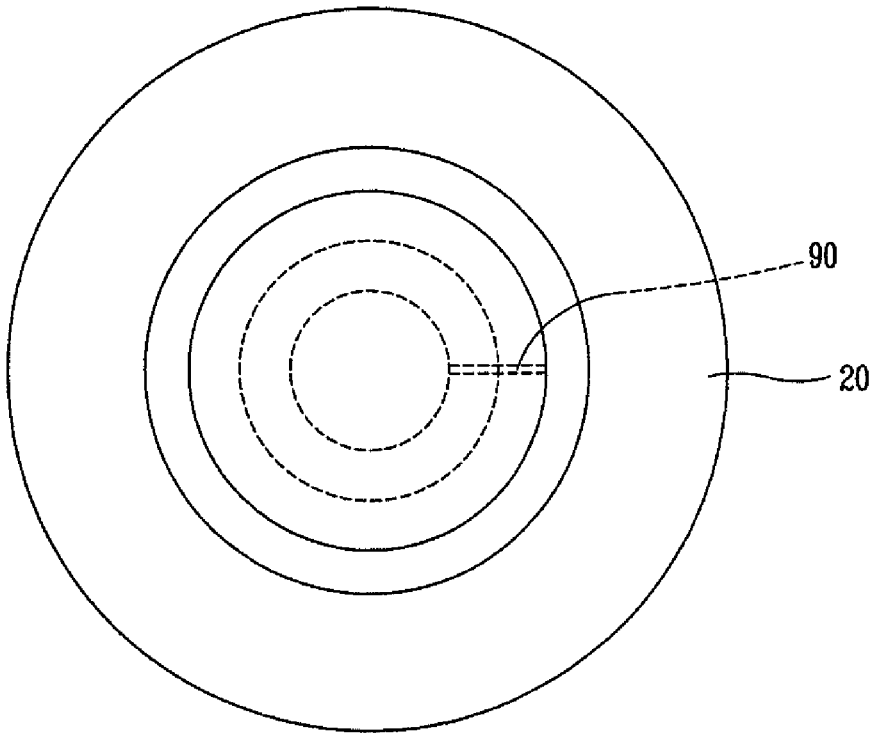
FIG. 4B is a plan view of FIG. 4A.
Figure 4C:
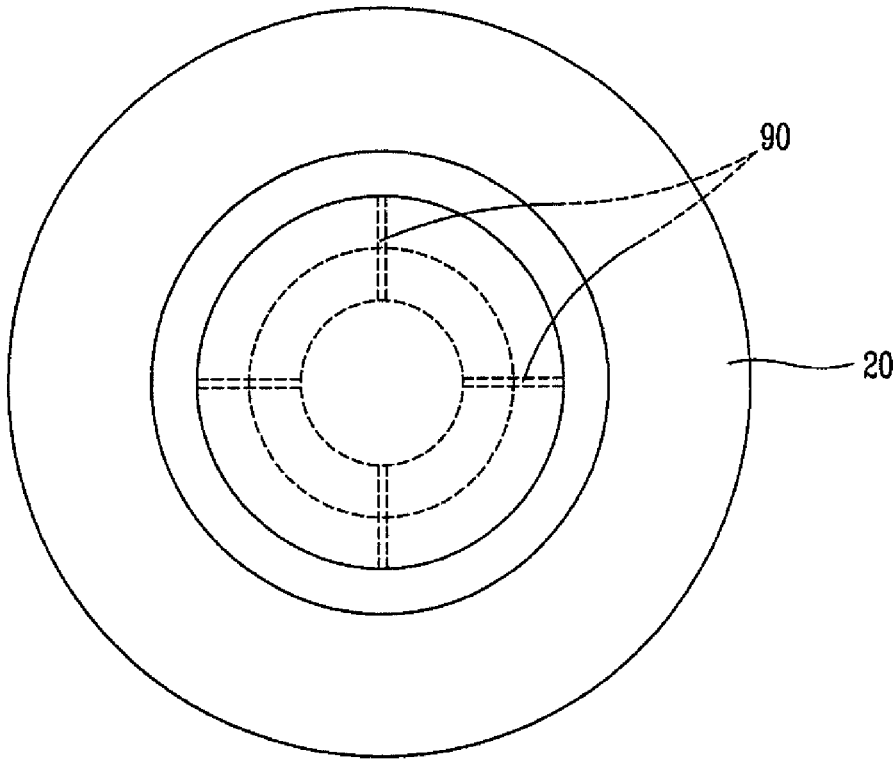
FIG. 4C is a plan view of the second electrode according to another embodiment of the present invention.
Figure 5:
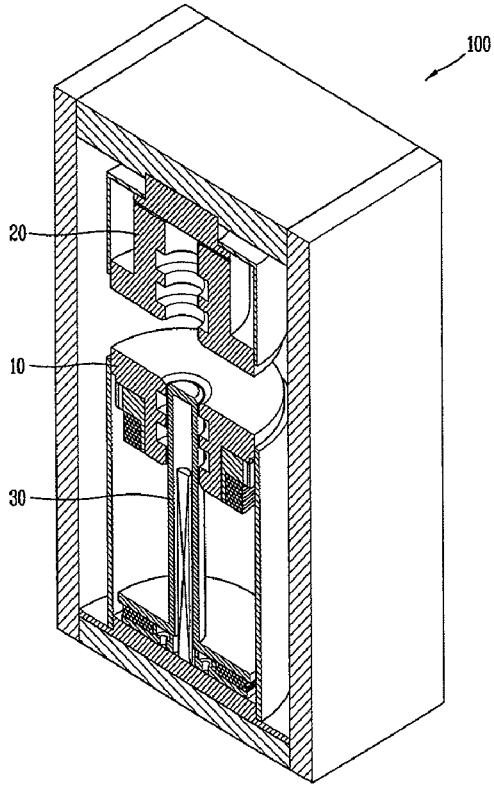
FIG. 5 shows an open state of the high speed closing switch according to one embodiment of the present invention.
Figure 6:
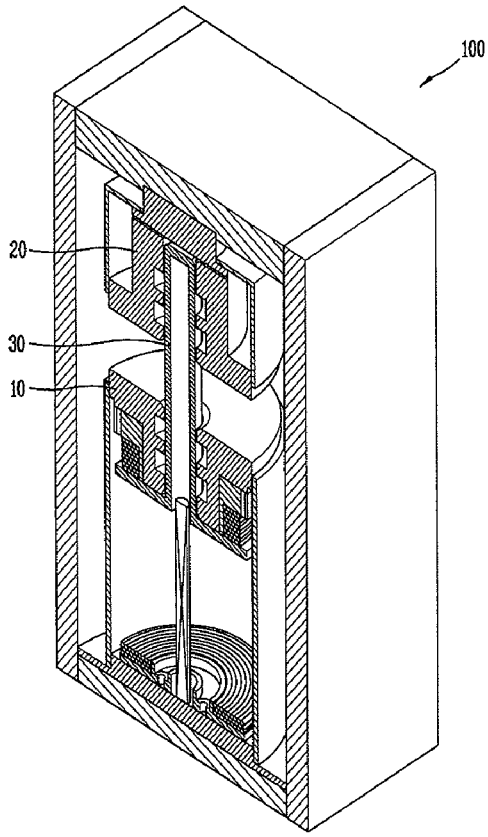
FIG. 6 shows an input state of the high speed closing switch of FIG. 3.

FIGS. 2 to 6 illustrate the high speed closing switch including a repeller (Thomson coil) using electronic repelling power according to embodiments of the present invention. FIG. 2 is a sectional view of a high speed closing switch of FIG. 1, FIG. 3 is a detailed sectional view of a first electrode and a moving contact point member of FIG. 2, FIG. 4A is a detailed sectional view of a second electrode, FIG. 4B is a plan view of FIG. 4A, FIG. 4C is a plan view of the second electrode according to another embodiment of the present invention, FIG. 5 shows an open state of the high speed closing switch according to one embodiment of the present invention, and FIG. 6 shows an input state of the high speed closing switch of FIG. 3.

With reference to FIG. 2, the high speed closing switch 100 includes a first electrode 10 and a second electrode 20 provided at an upper side of the first electrode in a facing manner within a case 200 forming an external appearance of the high speed closing switch 100. The first electrode 10 includes a through hole 14 therein, and the second electrode 20 includes a receiving recess 24 facing the through hole 14.

In an embodiment of the present invention, the high speed closing switch 100 includes a moving contact point member 30 received within the through hole 14 such that it can move up and down. When the moving contact point member 30 moves up and received in the receiving recess 24 of the second electrode 20, an outer circumferential surface of the moving contact point member 30 and an inner circumferential surface of the through hole 14 come in contact with each other, and the outer circumferential surface of the moving contact point member 30 and the inner circumferential surface of the receiving recess 24 also come in contact with each other, according to which the first and second electrodes are electrically connected.

The moving contact point member 30 includes a cylindrical portion 31 received in the through hole 14 so as to be put into the receiving recess 24 and a flange portion 33 formed at a lower portion of the cylindrical portion 31. A closing coil 80 is positioned under the flange portion 33 of the moving contact point member 30 and wound on a base 60 of the case 200. When an arc accident occurs, various magnetic fields are formed around the closing coil 80, generating an eddy current at the flange portion 33 of the moving contact point member 30. The eddy current forms a magnetic field again. The magnetic fields formed around the closing coil 80 and the magnetic field formed by the eddy current have the opposite directions, forming strong repulsive power between the closing coil 80 and the flange portion 33. The repulsive power instantly generates a strong force pushing up the flange portion 33 from the closing coil 80 wound on the base 60, and accordingly, the moving contact point member 30 instantly moves up at a fast speed so as to be put into the receiving recess 24 of the second electrode 20. The operation of inputting the moving contact point member 30 into the receiving recess 24 of the second electrode 20 owing to the strong repulsive power generated between the moving contact point member 30 and the closing coil 80 will be referred to as an 'inputting operation', hereinafter.

In the inputting operation, the moving contact point member 30 moves fast due to the early storing repulsive power. Thus, after the moving contact point member 30 is put into the receiving recess 24, kinetic energy of the moving contact point member needs to be absorbed, without applying an impact to the case 200 or the like, to make the moving contact point member stop at its proper position accurately. To this end, in the present invention, a damping hole 90 serving as an orifice is formed at the receiving recess 24 of the second electrode 20.

With reference to FIGS. 4A to 4C, the damping hole 90 may be formed to be upwardly vertical at an upper portion of the receiving recess 24 of the second electrode 20. Preferably, the damping hole 90 is formed in a radius direction at an upper portion of the receiving recess 24, and one or a plurality of damping holes may be formed. The plurality of damping holes 90 may be radially formed in a radius direction at the upper portion of the receiving recess. The size of the damping hole 90 to provide a damping force to the moving contact point member 30 may be determined in consideration of the shape or size of the receiving recess 24 or the moving contact point member 30, but in order to provide a sufficient damping force, the damping hole should have a sufficiently small diameter.

Preferably, an inner diameter of a lower portion of the receiving recess 24 of the second electrode 20 is formed to be larger than an outer diameter of the cylindrical portion 31 of the moving contact point member 30, so that when the moving contact point member 30 is input at an early stage, a damping force by a compression gas is not generated, and when an upper portion of the cylindrical portion of the moving contact point member 30 comes in contact with the inner circumferential surface of the receiving recess, the role of the electrical contact of the moving contact point member 30 is completed at the moment, so a mechanical damping force starts to be generated. Namely, the diameter of the inner circumferential surface of the receiving recess 24 of the second electrode 20 is slightly increased at the lower portion.

Regarding the operation of the damping force by the damping hole, when the moving contact point member 30 moves up by the repulsive power and starts to be put into the receiving recess in the inputting operation, a damping force starts to be applied by a gas present within the receiving recess 24. Namely, when the upper portion of the moving contact point member is put into the receiving recess, an upper end of the moving contact point member stops up the lower portion of the receiving recess and the gas within the receiving recess may leak from the receiving recess only through a gap between the outer circumferential surface of the moving contact point member and the inner circumferential surface of the receiving recess or through the damping hole 90. At this time, if the size of the gap or the damping hole is sufficiently small, air within the receiving recess is compressed as the moving contact point member is input and the amount of air leakage is very small, increasing a gas pressure within the receiving recess.

The compressing force of the internal gas acts as a repulsive force to the moving contact point member 30 put into the receiving recess, absorbing kinetic energy of the moving contact point member, to thus generate a damping effect. In other words, in the present invention, the moving contact point member has a bar shape, so when it is inserted into the second electrode, the sealed gas is leaked along a small discharge passage, whereby the speed of the moving contact point member can be reduced at its final position by the resistance of the fluid.

One of the first electrode 10 and the second electrode 20 is connected to a ground and another is connected to a high voltage side. Thus, when an arc occurs in the power distributor, the moving contact point member electrically connects the first and second electrodes according to the inputting operation, thus connecting the generated arc to the ground.

In the moving contact point member 30, the interior of the cylindrical portion 31 is hollow for speed improvement through mass reduction, and a guide member 35 is provided within the cylindrical portion 31 to guide a movement of cylindrical portion 31 when the moving contact point member 30 is moved.

The guide member 35 has a cylindrical shape and is formed to extend upwardly from the base 60 of the case. The guide member 35 is inserted into the internal hollow 32 of the cylindrical portion 31 of the moving contact point member 30 to guide the movement of the cylindrical portion 31. The guide member 30 needs to have a sufficient vertical length to guide an upward movement of contact point member in the inputting operation.

When detouring of the accident current caused by the generated arc is completed through the inputting operation, it should return to the opening state. To this end, in order to open the moving contact point member 30 upon receiving a repulsive force by the closing coil 80, which has been put into the receiving recess 24, at its original position, an opening coil 70 is wound below the first electrode 10. Namely, the moving contact point member is returned to its original position by a repulsive force of the flange portion 33 of the moving contact point member 30 and the opening coil 70. This operation will be referred to as the 'opening operation', hereinafter.

When the moving contact point member is put into the receiving recess of the second electrode according to the inputting operation, the flange portion 33 of the moving contact point member 30 is positioned below the first electrode 10, and in this case, because the opening coil 70 is wound below the first electrode, current is applied to the opening coil to provide a repulsive force to the flange portion to move down the moving contact point member. The principle of generating the repulsive force is the same as in the inputting operation, so its detailed description will be omitted.

In the high speed closing switch according to an embodiment of the present invention, a contact element is formed on the inner circumferential surface of the through hole 14 and on the inner circumferential surface of the receiving recess 24 of the second electrode 20 and comes in contact with the moving contact point member 30 so as to be electrically connected. A first recess 11 is formed in a spiral form on the inner circumferential surface of the through hole 14 and a first protrusion 12 is formed between the first recesses 1. A second recess 21 is formed in a spiral form on the inner circumferential surface of the receiving recess 24 of the second electrode 20 and a second protrusion 22 is formed between the second recesses 21. The outer circumferential surface of the moving contact point member 30 is electrically connected by being in contact with the first protrusion 12 or the second protrusion 22.

A pipe 40 is provided within the case 200, covering the first electrode 10. The pipe 40 has a substantially hollow cylindrical shape. The first electrode 10 is combined at an upper portion of the inner circumferential surface of the hollow, and a lower portion of the pipe 40 is combined with the base 60 of the case. The pipe 40 covers to protect the first electrode and is made of conductive material to serve as a conductor.

The interior of the case 200 is filled with an inert gas and sealed against the exterior of the case. The inert gas filled at the inner side of the case 200 is $SF_6$, $N_2$, or air without moisture.

In the above description, the first electrode 10, the second electrode 20, and the moving contact point member 30 are separately fabricated and combined, but any of the elements may be integrally formed with another element. For example, the first electrode 10 and the moving contact point member 30 may be integrally formed and perform inputting operation by using a repulsive force generated between the closing coil and the flange portion. Namely, in this case, the first electrode serves as the moving contact point member.

Figure 7:
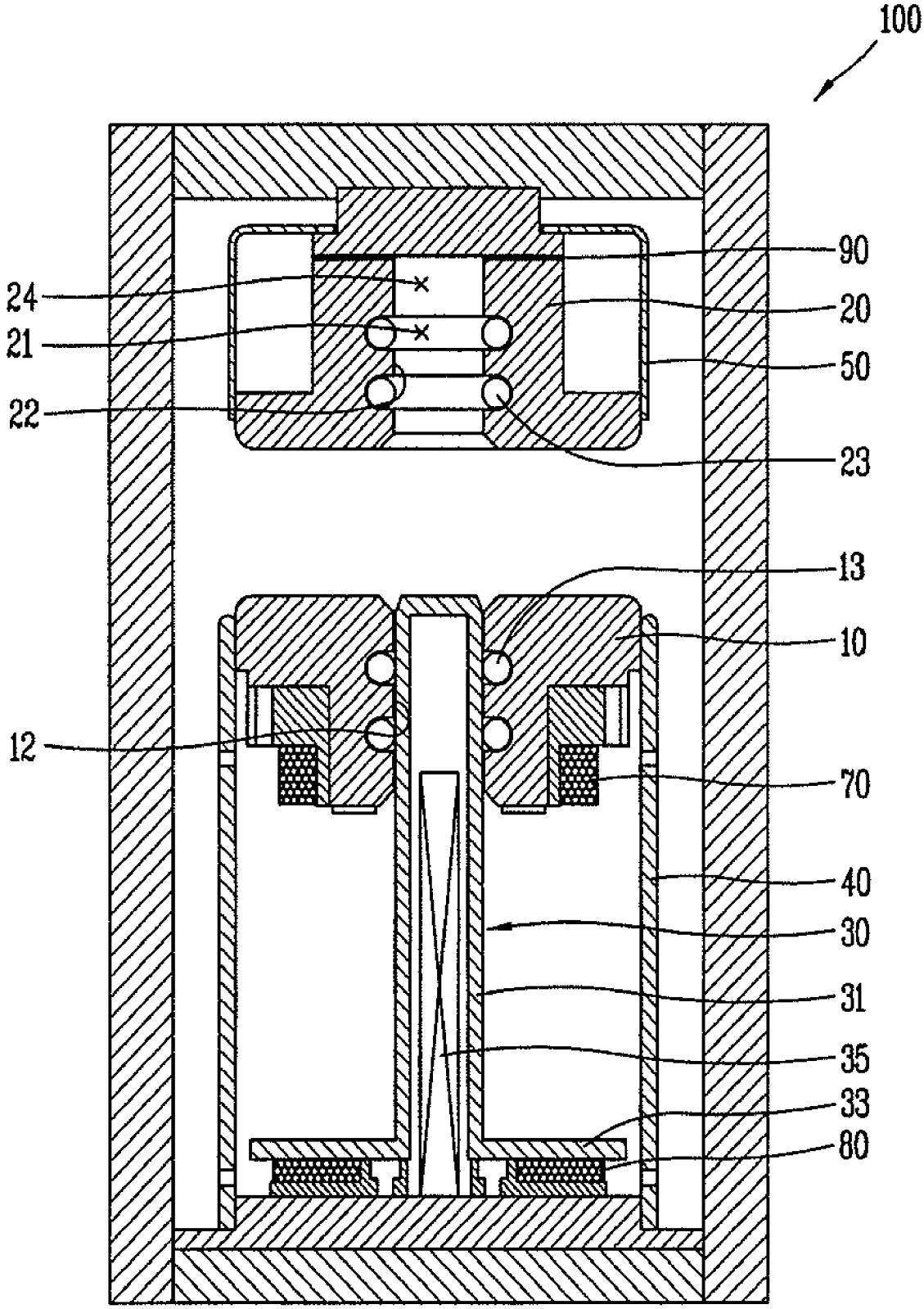
FIG. 7 is a sectional view of a high speed closing switch according to another embodiment of the present invention.

FIG. 7 is a sectional view of a high speed closing switch according to another embodiment of the present invention. As shown in FIG. 7, the first recess 11 is formed in a spiral form on the inner circumferential surface of the through hole 14 of the first electrode 10, and a first spring 13 is mounted in the first recess. The second recess 21 is formed in a spiral form on the inner circumferential surface of the receiving recess 24 of the second electrode 20. The first spring 13 and a second spring 23 are mounted in the first and second recesses, respectively. The outer circumferential surface of the moving contact point member 30 is in contact with the first and second springs to thus be electrically connected with the first and second electrodes.

According to the embodiments of the present invention, the power distributor includes the dedicated high speed closing switch to protect the system against an arc. The first electrode, the second electrode, the moving contact point member, and the coil for repulsion of the moving contact point member are integrated in the same space. In particular, the moving contact point member is moved with a very strong repulsive force at an early stage, but its final speed is reduced owing to the shape of moving contact point member and the receiving portion for receiving the moving contact point member at the second electrode to reduce an impact to thus facilitate controlling the final position of the moving contact point member.

With such configuration, the dedicated high speed closing switch is provided to cope with an arc generated within the power distributor, and an effective damper performance can be implemented at the final position of the moving unit by using a structural shape of the high speed closing switch and the insulation gas within the case. In addition, because the gas present within the case absorbs an impact generated in the high speed inputting operation, when the high speed closing switch is suddenly stopped from its operation, noise and impact can be reduced. Therefore, in the high speed closing switch according to the present invention, the final position of the moving unit can be smoothly controlled.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A high speed closing switch in a power distributor, comprising:

a case forming an external appearance;

a first electrode provided within the case and including a through hole;

a second electrode having a receiving recess facing the through hole;

a moving contact point member having a cylindrical portion received in the through hole so as to be put into the receiving recess and a flange portion formed at one end of the cylindrical portion; and a closing coil wound on a base of the case, wherein a damping hole is formed in a radius direction at an upper portion of the receiving recess of the second electrode.

2. The switch of claim 1, the moving contact point member is put into the receiving recess upon receiving a repulsive force by the closing coil in the inputting operation.

3. The switch of claim 1, wherein an opening coil is wound at one side of the first electrode to provide a repulsive force to the moving contact point member in an opening operation.

4. The switch of claim 1, further comprising:

a case accommodating the first and second electrodes and having the closing coil positioned at its lower portion.

5. The switch of claim 1, wherein the interior of the cylindrical portion of the moving contact point member is hollow, and a guide member is provided at a base of the case, so as to be inserted in the hollow of the cylindrical portion to guide the movement of the cylindrical portion.

6. The switch of claim 1, wherein a lower portion of an inner diameter of the receiving recess of the second electrode is larger than a middle portion of the inner diameter of the receiving recess.

7. The switch of claim 1, wherein a contact element being in contact with the moving contact point member is formed on an inner circumferential surface of the through hole of the first electrode and on an inner circumferential surface of the receiving recess of the second electrode.

8. The switch of claim 7, wherein the contact element is a protrusion formed between a spiral recess formed on the inner circumferential surface of the through hole.

9. The switch of claim 7, wherein the contact element is a spring mounted in the spiral recess formed on the inner circumferential surface of the through hole.

10. The switch of claim 4, further comprising:

a pipe having the first electrode combined to one side of the inner circumferential surface of the pipe and having the other side combined to a base of the case.

11. The switch of claim 1, wherein a plurality of damping holes are formed.

12. The switch of claim 1, wherein the first electrode is connected to a ground, and the second electrode is connected to a high voltage side.

13. The switch of claim 4, wherein the interior of the case is filled with an inert gas and hermetically closed against the exterior.

14. The switch of claim 13, wherein the inert gas comprises $SF_6$, $N_2$, or air without moisture.

* * * * *